United States Patent [19]

Butler

[11] 3,938,690

[45] Feb. 17, 1976

[54] SPILL-PROOF DRINKING CONTAINER

[75] Inventor: Robert C. Butler, Rancho Palos Verde, Calif.

[73] Assignee: The Raymond Lee Organization, Inc., New York, N.Y. ; a part interest

[22] Filed: Jan. 8, 1975

[21] Appl. No.: 539,445

[52] U.S. Cl. ..... 220/90.4; 220/254; 220/348

[51] Int. Cl.[2] ..... A47G 19/22

[58] Field of Search ..... 220/90.2, 90.4, 254, 348; 215/315; 222/511, 561

[56] References Cited

UNITED STATES PATENTS

| | | | |
|---|---|---|---|
| 562,577 | 6/1896 | Clasen | 220/348 |
| 1,980,049 | 11/1934 | Gainer | 222/511 |
| 2,159,978 | 5/1939 | Parkin | 220/254 X |
| 2,433,142 | 12/1947 | Moen | 220/348 |
| 2,757,859 | 8/1956 | Holland | 220/254 X |
| 2,884,157 | 4/1959 | Lampkin | 220/90.4 X |
| 3,217,940 | 11/1965 | Fahn | 222/511 X |
| 3,412,892 | 11/1968 | Waksman | 220/90.4 |

*Primary Examiner*—Donald F. Norton
*Attorney, Agent, or Firm*—Daniel Jay Tick

[57] ABSTRACT

A cover is mounted in a leakproof manner over the open mouth of a drinking container. An opening is formed through the cover in the area of the circumference of the cover. A closure member is slidably mounted on the cover for movement over the opening whereby the container is rendered spill-proof and for movement to a position free from the opening whereby a user may pour and drink liquid in the container through the opening in the cup.

1 Claim, 4 Drawing Figures

SPILL-PROOF DRINKING CONTAINER

DESCRIPTION OF THE INVENTION

The present invention relates to a spill-proof drinking container.

Objects of the invention are to provide a spill-proof drinking container of simple structure, which is inexpensive in manufacture, and functions efficiently, effectively and reliably to prevent liquid in the container from spilling under any conditions such as, for example, carrying or attempting to drink or pour liquid from the container in a moving vehicle or vessel.

In order that the invention may be readily carried into effect, it will now be described with reference to the accompanying drawing, wherein.

In the FIGS., the same components are identified by the same reference numerals.

Figure 1:
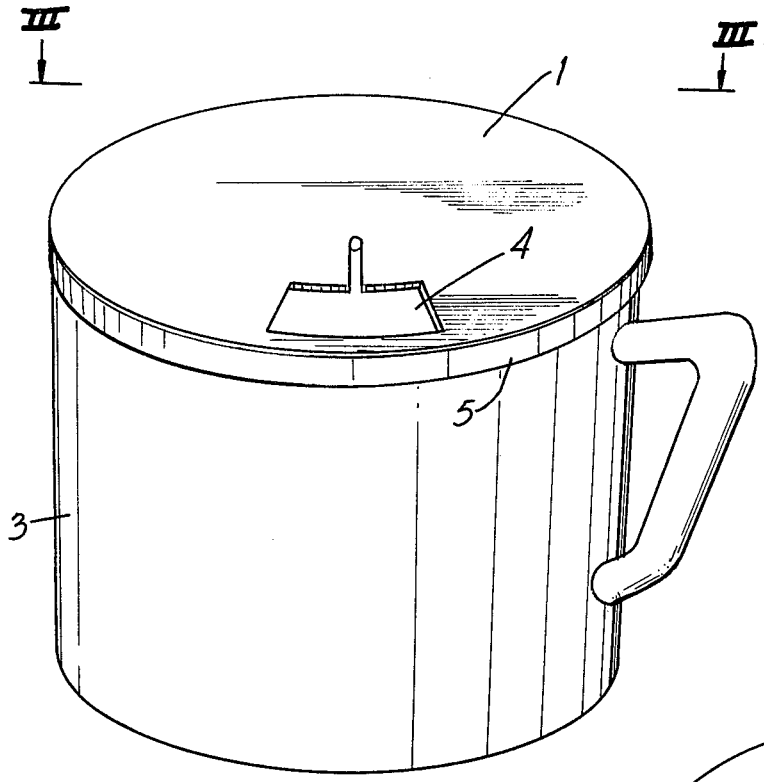
FIG. 1 is a perspective view of an embodiment of the spill-proof drinking container of the invention.
Figure 2:
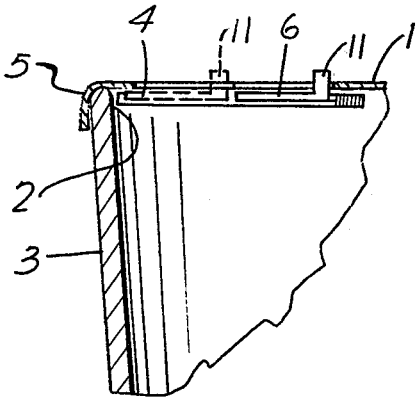
FIG. 2 is a sectional view of a corner of the embodiment of FIG. 1.
Figure 3:
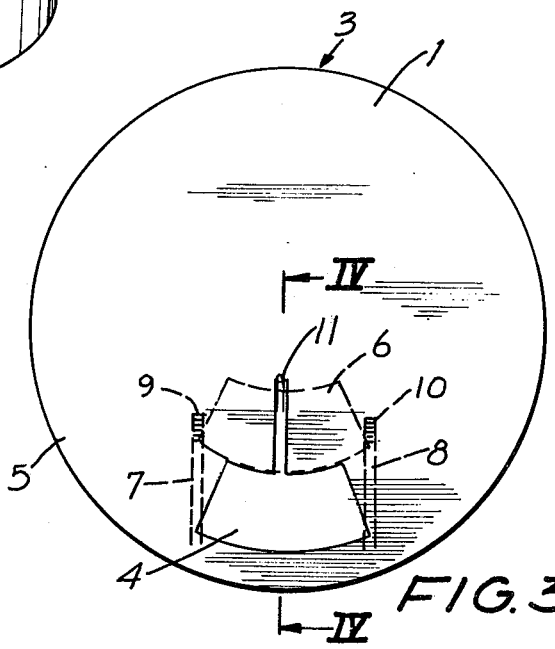
FIG. 3 is a view, taken along the lines III—III, of FIG. 1.

The spill-proof drinking container of the invention comprises a cover 1 mounted in a substantially leakproof manner over the open mouth 2 (FIG. 2) of a drinking container 3 (FIGS. 1, 2 and 3). The cover 1 has an opening 4 (FIGS. 1 to 3) formed therethrough in the area of the circumference 5 (FIGS. 1 to 3) of the cover.

Figure 4:
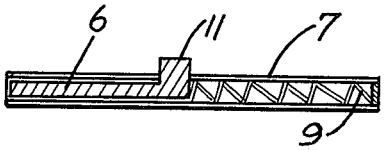
FIG. 4 is a cross-sectional view, on an enlarged scale, taken along the lines IV—IV, of FIG. 3.

A closure member 6 (FIGS. 2, 3 and 4) is slidably mounted in the cover 1 for movement over the opening, whereby the container 3 is rendered spill-proof, and for movement to a position free from the opening 4, whereby a user may pour and drink liquid in the container through the opening in the cover. In FIG. 2, the closure member 6 is shown in its position free from the opening 4 in solid lines, and in FIG. 3, said closure member is shown in said position in broken lines. In FIG. 2, the closure member 6 is shown in its position over the opening 4 in broken lines.

In accordance with the invention, a guide device 7, 8 is provided on the underside of the cover 1 for guiding the closure member 6. The closure member 6 is movably mounted in the guide device 7, 8, which may comprise a pair of spaced guide rail-type members, as shown in FIG. 3. Springs 9 and 10 (FIGS. 3 and 4) are mounted in close proximity with the closure member 6 in the guide device 7, 8 and abut said closure member for urging the closure member over the opening 4, so that the springs maintain the closure member over the opening and thereby maintain the container 3 in leakproof and spill-proof condition.

A projecting member 11 (FIGS. 2 to 4) extends from the overside of the closure member 6 to facilitate manual movement of the closure member in the guide device.

While the invention has been described by means of a specific example and in a specific embodiment, I do not wish to be limited thereto, for obvious modifications will occur to those skilled in the art without departing from the spirit and scope of the invention.

I claim:

1. A spill-proof drinking container, comprising a cover mounted in a substantially leakproof manner over the open mouth of a drinking container and having an opening formed therethrough in the area of the circumference of the cover;

a closure member slidably mounted on the cover for movement over the opening whereby the container is rendered spill-proof and for movement to a position free from the opening whereby a user may pour and drink liquid in the container through the opening in the cover;

guide means on the underside of the cover for guiding the closure member, said closure member being movably mounted in the guide means;

a projecting member extending from the overside of the closure member to facilitate manual movement of the closure member in the guide means; and compression spring means mounted in close proximity with the closure member in the guide means and abutting the closure member for urging the closure member over the opening.

* * * * *